United States Patent [19]

Crnojevich et al.

[11] 4,175,014

[45] Nov. 20, 1979

[54] CATHODIC DISSOLUTION OF COBALTIC HYDROXIDE

[75] Inventors: Ranko Crnojevich, Gretna; Edward I. Wiewiorowski, New Orleans; Peter H. Yu, Harvey, all of La.

[73] Assignee: AMAX Inc., Greenwich, Conn.

[21] Appl. No.: 883,378

[22] Filed: Mar. 6, 1978

[51] Int. Cl.[2] ..... C25C 1/08

[52] U.S. Cl. ..... 204/130; 75/119

[58] Field of Search ..... 204/130, 112; 75/119

[56] References Cited

U.S. PATENT DOCUMENTS

| | | | |
|---|---|---|---|
| 3,673,062 | 6/1972 | Smith et al. | 204/112 |
| 3,933,976 | 1/1976 | Nikolic et al. | 75/119 |

*Primary Examiner*—R. L. Andrews

*Attorney, Agent, or Firm*—Michael A. Ciomek; Eugene J. Kalil

[57] ABSTRACT

A method is provided for the recovery of cobalt from nickel solutions, wherein cobalt is separated from said solution as a precipitate containing cobaltic hydroxide precipitate and also containing nickel, the method comprising dissolving the precipitate for the subsequent recovery of cobalt therefrom by reducing trivalent metal in said precipitate to the divalent state. This is achieved by forming an aqueous slurry of said precipitate acidified with sulfuric acid to a pH ranging from about 0.1 to 2, subjecting the precipitate of said aqueous slurry to electrolytic reduction at the cathode of an electrolytic cell having an insoluble anode, said precipitate being isolated from said anode during said electrolytic reduction and continuing the electrolytic reduction of said precipitate from the trivalent to the divalent state and effect the dissolution thereof.

7 Claims, No Drawings

CATHODIC DISSOLUTION OF COBALTIC HYDROXIDE

This invention relates to the dissolution of cobaltic hydroxide-containing precipitates by the electrolytic reduction of trivalent cobalt and any trivalent nickel present in said precipitate to the divalent state.

BACKGROUND OF THE INVENTION

It is known to produce cobaltic hydroxide-containing precipitates as a by-product in the hydrometallurgical treatment of nickel-bearing materials, such as oxidic nickel ores or nickel sulfide contentrates, where it is desired to separate the cobalt from the nickel. Nickel and cobalt are usually found together in natural-occurring minerals and, because conventional ore dressing methods do not effect a separation of these two elements, both metals generally appear together in solutions resulting from the leaching of oxide ores or the oxidation leaching of nickel sulfide concentrates or mattes.

In recent years, several hydrometallurgical methods have been proposed for the recovery of nickel and cobalt from lateritic ores or from nickel and nickel-copper mattes. With regard to the former, reference is made to U.S. Pat. No. 3,933,975, No. 3,933,976 and No. 4,034,059, among others. As regards the leaching of nickel and nickel-copper concentrates or mattes, reference is made to U.S. Pat. No. 3,293,037, No. 3,741,752 and No. 3,962,051.

The nickel leach solution obtained from the foregoing nickeliferous materials usually contains cobalt which is generally removed in order to provide a high purity nickel solution, for example, a solution having a nickel-to-cobalt ratio of over 1000:1. One method for removing the cobalt from solution as a cobaltic hydroxide is disclosed in U.S. Pat. No. 3,933,976.

The ratio of Ni/Co in the precipitate is normally about 2 to 5 (and may range as high as 10:1). After the cake has been washed (repulped) with water or acidified water (pH about 2.5), the Ni/Co ratio is improved and normally averages about 0.5 to 1.5. The precipitate is then further processed to reclaim the contained nickel values therein and to obtain a pure marketable cobalt product.

In order to refine further the cobaltic precipitate, it has to be dissolved or leached which is not easily accomplished. One method which has been proposed is that disclosed in U.S. Pat. No. 3,933,975. According to this patent, cobalt black is leached with strong ammonia-ammonium sulfate solution at elevated temperatures of 180° F. to 300° F. (82° C. to 149° C.). While the method is commercially acceptable, a drawback is that the leach residue presents a considerable filtration problem. Moreover, the dissolution tends to be incomplete. A complete dissolution is a highly desirable goal because of the high market value for cobalt.

Complete dissolution can be effectively achieved by employing sulfuric acid in the presence of $SO_2$ gas. However, the cobalt metal product produced from the $H_2SO_4$—$SO_2$ leach product contains an intolerably high sulfur content ranging from about 0.4% to 1% S, generally in the form of cobalt sulfide.

The use of sulfuric acid dissolution in the presence of metallic reductants (e.g. Co, Ni, Fe, Zn) instead of $SO_2$ has been proposed but this process has not been very desirable because of cost and the tendency of introducing foreign ions (e.g. Fe, Zn) into the processing streams. The use of metallic nickel or cobalt as a reductant, while compatible with the process, adds to the production cost.

The invention overcomes the aforementioned disadvantages in that substantially complete dissolution is readily obtainable, the dissolution residue is easily filterable, the method of the invention is more economically attractive, does not introduce any foreign ions and, moreover, a low sulfur cobalt product is obtainable.

OBJECTS OF THE INVENTION

It is an object of the present invention to provide an improved method for the dissolution of precipitates comprising cobalt in the cobaltic state.

Another object is to provide a method for the recovery of cobalt from precipitates containing cobalt in the cobaltic state by the electrolytic reduction of the trivalent ("ic" -state) in the precipitate to the divalent or "ous" state.

These and other objects will more clearly appear when taken in conjunction with the following disclosure and the appended claims.

STATEMENT OF THE INVENTION

In carrying the invention into practice, cobalt is recovered from nickel leach solutions by separating it from the solution as a cobaltic hydroxide precipitate which also contains nickel. The precipitate is then dissolved by reducing the trivalent metal therein to the divalent state, the method comprising forming an aqueous slurry of said precipitate acidified with sulfuric acid to a pH of from about 0.1 to 2, subjecting the precipitate of said aqueous slurry to electrolytic reduction at the cathode of an electrolytic cell having an insoluble anode, said precipitate being isolated from said anode during said electrolytic reduction, and continuing the electrolytic reduction of said precipitate at said cathode until reduction of said precipitate from the "ic" to the "ous" state is obtained and hence the substantial dissolution thereof.

As stated earlier, the cobalt hydroxide precipitate is generally obtained, as stated hereinbefore, as an intermediate product in the process of separating cobalt from nickel sulfate leach solution. The nickel solutions usually contain relatively high amounts of nickel, e.g. 50 to 100 gpl (grams per liter) nickel, and relatively low concentrations of cobalt, for example, 0.5 to 5 gpl cobalt. In carrying out the cobalt precipitation process, a portion of the cobalt-containing nickel stream obtained during leaching is diverted to the preparation of nickelic hydroxide which is subsequently combined with the main nickel stream to effect removal of cobalt therefrom as a cobaltic hydroxide-containing precipitate.

The nickelic hydroxide precipitate is first produced by precipitating nickelous hydroxide [$Ni(OH)_2$]which is thereafter oxidized into a high valency nickel compound containing both $Ni^{+3}$ and $Ni^{+4}$ known as nickelic hydroxide or "nickel black" which is commonly represented by the formula NiOOH or $Ni(OH)_3$. One method of oxidizing the nickelous precipitate [$Ni(OH)_2 \rightarrow NiOOH$]is to employ an electrolytic process in which the precipitate is oxidized at the anode in a galvanic cell. Another method is to use strong oxidizing agents, such as chlorine gas, ozone, sodium hypochlorite or a mixture of $O_2+SO_2$. The foregoing methods of oxidation are disclosed in U.S. Pat. No. 3,933,976 which is incorporated herein by reference.

The nickelic hydroxide obtained by any one of the foregoing or other methods is very effective in precipitating the cobaltous ion from the nickel solutions in accordance with the following reactions:

$$NiOOH + Co^{++} \rightarrow CoOOH + Ni^{++}$$

$$Ni(OH)_3 + Co^{++} + 2H_2O \rightarrow Co(OH)_3 + Ni(OH)_2 + 2H^+$$

The product of the foregoing reactions is a high valency cobalt compound known either as cobaltic hydroxide or "cobalt black". This method generally reduces or depletes the cobalt content of the nickel solution from a level, for example, of 0.5 to 5 gpl Co down to 0.05 gpl or less, e.g. to about 0.01 gpl Co.

However, the cobalt black precipitate carries with it a significant amount of nickel, such as occluded nickel solution, unreacted nickel black or the simple nickelous hydroxide generated during the cobalt separation process.

Since cobalt black and nickel black pose difficult filtration problems, a filter aid is generally employed dispersed in the slurry and hence the precipitate. A typical filter aid is one referred to by the trademark "Perlite" which is a fused sodium-potassium aluminum silicate. Another example of a filter aid is one identified by the trademark "Celite" or "Diatomite", the filter aid being a siliceous mineral comprised of skeletons of microscopic plants, otherwise referred to as infusorial earth. Still another filter aid is one known in the trade as "Solca-Floc" comprising particulate cellulose material.

DETAILS OF THE INVENTION

In carrying out the reduction at the cathode, the reaction may occur in two ways as follows:

(a) by direct reduction of the cobaltic ion at the cathode surface:

$$Co^{3+} + e^- \rightarrow Co^{2+} \quad (1)$$

(b) by reaction with nascent hydrogen evolving at the cathode in an aqueous solution of sulfuric acid:

$$H_2O \rightarrow 2H^* + \tfrac{1}{2}O_2 \quad (2)$$

$$2CoOOH + 2H^* \rightarrow 2Co(OH)_2 \quad (3)$$

and then $$Co(OH)_2 + H_2SO_4 \rightarrow CoSO_4 + 2H_2O \quad (4)$$

One embodiment for carrying out the invention comprises forming a slurry of the cobaltic cake or precipitate (containing or free of a filter aid) in water which is thereafter acidified with $H_2SO_4$ to a pH range of about 0.1 to 2.0, preferably in the range of about 0.4 to 0.6. The slurry is placed in the electrolytic cell of any conventional design in which the anode surface is preferably isolated by a semi-permeable membrane in order to isolate the precipitate from the anode. Filter cloth, filter paper or any type of membrane which will allow the solution to flow through it but which will prevent the cobaltic cake solids from contacting the anode can be used. The slurry temperature in the cell can be maintained anywhere between ambient and below the boiling point. From the practical as well as the kinetics viewpoint, a temperature of between 50° C. to 80° C. is preferred.

The cell voltage may vary from about 1.5 to 4 volts. Better current efficiency is obtainable at lower voltages but the kinetics may be impractically slow. The most preferred range for optimum economics and kinetics is 2.5 V to 3.5 V. The dissolution kinetics can be enhanced by increasing the cathode surface area and by increasing the cathode current density. While there are no chemical limitations on the current density, it may normally range between about 5 and 100 amps/sq.ft. and, more preferably, between about 5 to 20 amps/sq.ft. Depending on the overall conditions, the dissolution time may vary from about 1 to 12 hours and generally from about 2 to 4 hours. The dissolution end point can be determined visually: the solids of the cobalt black (free of filter aid) will dissolve and disappear completely; or the cobalt black containing filter aid will turn sharply from a black color to a white-pink color.

An iodometric titration determination of residual $Me^{3+}$concentration in the slurry with potassium iodide is another useful way of following dissolution rate as well as of determining the end point.

During the dissolution, the slurry pH tends to rise as the cobalt black is being dissolved so that some sulfuric acid may have to be added (if not all required acid is supplied initially) so that the pH remains in the range of up to about 2, and generally from about 0.8 to 1.2.

The choice of the construction material for the cell as well as for the electrodes is optional. Thus, any material conventionally used for electroprocessing in sulfuric acid medium can be employed. The insoluble anode material, for example, can be lead, antimonial lead, titanium, graphite and the like. Cathode material can be of many metals like nickel, cobalt, copper, titanium, as well as corrosion resistant alloys like those available in the stainless steel series. Graphite may also be employed as a cathode.

The invention enables substantially complete dissolution of cobalt black which is important in providing optimum recovery of valuable metals (Ni, Co) and in producing an easily filterable slurry where the cobalt black contains an amount of filter aid.

The invention is economically more attractive than straight dissolution using metallics as the reductant. In addition, the introduction of foreign ions or substances is avoided as compared to the $SO_2$ dissolution method.

As illustrative of the various embodiments of the invention, the following examples are given:

EXAMPLE 1

About 274 gr of wet cobalt black assaying by weight 8.97% Ni, 7.31% Co, 7.3% $Me^{3+}$ and containing 9.2% filter aid and 49.2% moisture was slurried in 500 ml of water. Sufficient sulfuric acid was added to provide a stoichiometric molar ratio ($H_2SO_4$/total Ni+Co) of about 1. The slurry was heated to 100° F. (38° C.) and placed in an electrolytic cell with a stainless steel cathode having an effective surface area of 150 sq.in. and a lead anode having an effective surface area of 15 sq.in. The anode was separated from the precipitate by a permeable cellulose diaphragm. A direct current of about 5 amps was passed through the cell at 3.5 V. A substantially complete dissolution was achieved in 6 hours with a current efficiency of about 30.3%.

EXAMPLE 2

A 548 gr sample of wet cobalt black assaying 8.23% Ni, 8.24% Co, 8.3% $Me^{3+}$ and containing 8.6% filter aid and 49.0% moisture was slurried in 1000 ml of water. Sufficient sulfuric acid was added to adjust the pH to about 1. The slurry was heated to 140° F. (60° C.) and placed in an electrolytic cell having an effective surface area of 300 sq.in. and a lead anode having an effective area of 30 sq.in. The anode area separated from the precipitate by a permeable cellulose diaphragm. A direct current of 1.25 amps was passed through the cell at 2.2 V. A complete dissolution was achieved at 11 hours with a current efficiency of about 72.8%. The pH of about 1 was maintained during the course of dissolution with the addition of fresh sulfuric acid.

EXAMPLE 3

A 274 gr sample of wet cobalt black assaying 8.97% Ni, 7.31% Co, 7.3% $Me^{3+}$ and containing 9.2% filter aid and 49.2% moisture was slurried in 500 ml of water. Sufficient sulfuric acid was added to provide a stoichiometric molar ratio ($H_2SO_4$/total Ni+Co) of 1. The slurry was heated to 170° F. (77° C.) and placed in an electrolytic cell with a stainless steel cathode having an effective surface area of 150 sq.in. and a lead anode having an effective surface area of 15 sq.in. The anode was separated from the precipitate by a permeable cellulose diaphragm. A direct current of 11 amps at 3.5 V was passed through the cell. A substantially complete dissolution was achieved in 2½ hours with a current efficiency of about 33.1%.

EXAMPLE 4

About 500 ml of a cobaltic cake slurry containing 37.9 gpl $Me^{3+}$, 39.1 gpl total Co and 38.5 gpl total Ni was treated with sulfuric acid to adjust the molar ratio of $H_2SO_4/Me^{3+}$ to about 1.5. The slurry was placed in an electrolyte cell with a stainless steel cathode having an effective surface area of 150 sq.in., and a lead anode having an effective surface area of 15 sq.in. The anode area was separated from the slurry by a permeable cellulose diaphragm. A direct current of 4 amps. at 3.0 V and at 90° F. (32° C.) was passed through the cell. After 4 hours, the trivalent metal concentrations dropped to 6.4 gpl $Me^{3+}$ with a current efficiency of 47.3%. Complete dissolution was reached after 7 hours with an overall current efficiency of 30.8%.

Although the present invention has been described in conjunction with preferred embodiments, it is to be understood that modifications and variations may be resorted to without departing from the spirit and scope of the invention as those skilled in the art will readily understand. Such modifications and variations are considered to be within the purview and scope of the invention and the appended claims.

What is claimed is:

1. In the recovery of cobalt from cobalt-containing nickel solutions, wherein cobalt is separated from said solution as a precipitate containing cobaltic hydroxide, the improved method of dissolving said precipitate for the subsequent recovery of cobalt therefrom by reduction of trivalent metal in said precipitate to the divalent state which comprises, forming an aqueous slurry of said precipitate acidified with sulfuric acid to a pH ranging from about 0.1 to 2, subjecting the precipitate of said aqueous slurry to electrolytic reduction at the cathode of an electrolytic cell having an insoluble anode, said precipitate being isolated from said anode during said electrolytic reduction, and continuing the electrolytic reduction of said precipitate at said cathode until reduction of trivalent metal in said precipitate to the divalent state obtains and hence the dissolution thereof.

2. The method of claim 1, wherein the electrolytic reduction is carried out at a cell voltage of 1.5 to 4 volts at a cathode current density of about 5 to 100 amps/sq.ft., and at a temperature ranging from ambient to below the boiling point of the aqueous slurry.

3. The method of claim 2, wherein the cell voltage ranges from about 2.5 to 3.5 volts, at a cathode current density of about 5 to 20 amps/sq.ft. and at a temperature ranging from about 50° C. to 80° C.

4. The method of claim 1, wherein as the pH rises during dissolution, sulfuric acid is added to control the pH over the range of about 0.8 to 1.2.

5. In the recovery of cobalt from cobalt-containing nickel solutions, wherein cobalt is separated from said solution as a precipitate containing cobaltic hydroxide and also containing nickel, the improved method of dissolving said precipitate for the subsequent recovery of cobalt therefrom by reduction of trivalent metal in said precipitate to the divalent state which comprises, forming an aqueous slurry of said precipitate acidified with sulfuric acid to a pH ranging from about 0.2 to 2, subjecting the precipitate of said slurry to electrolytic reduction at the cathode of an electrolytic cell having an insoluble anode at a cell voltage ranging from about 1.5 to 4 volts, at a cathode current density ranging from about 5 to 100 amps/sq.ft. and at a temperature ranging from ambient to below the boiling point of the aqueous slurry, said precipitate being isolated from said anode during said electrolytic reduction, and continuing the electrolytic reduction of said precipitate at said cathode until reduction of trivalent metal in said precipitate to the divalent state obtains and hence the dissolution thereof.

6. The method of claim 5, wherein the cell voltage ranges from about 2.5 to 3.5 volts, at a cathode current density of about 5 to 20 amps/sq.ft. and at a temperature ranging from about 50° C. to 80° C.

7. The method of claim 5, wherein as the pH rises during dissolution, sulfuric acid is added to control the pH over the range of about 0.8 to 1.2.

* * * * *

UNITED STATES PATENT OFFICE

CERTIFICATE OF CORRECTION

Patent No. 4,175,014 Dated November 20, 1979

Inventor(s) Ranko Crnojevich et al

It is certified that error appears in the above-identified patent and that said Letters Patent are hereby corrected as shown below:

Column 3, line 45, the formula given as:

$$H_2O \rightarrow 2H^\circ + 1/2_2$$

should be $$--H_2O \rightarrow 2H^\circ + 1/2\, O_2--$$

Signed and Sealed this

*Twentieth* Day of *May 1980*

[SEAL]

*Attest:*

SIDNEY A. DIAMOND

*Attesting Officer*

*Commissioner of Patents and Trademarks*